United States Patent [19]

Stanley

[11] Patent Number: 4,552,516

[45] Date of Patent: Nov. 12, 1985

[54] PERISTALTIC PUMP

[75] Inventor: Deryl B. Stanley, Huntley, Ill.

[73] Assignee: Cole-Parmer Instrument Company, Chicago, Ill.

[21] Appl. No.: 620,906

[22] Filed: Jun. 15, 1984

[51] Int. Cl.[4] ..... F04B 43/12; F04B 45/08

[52] U.S. Cl. ..... 417/477; 24/517

[58] Field of Search ..... 417/477, 476, 475; 24/505, 506, 517, 544, 542

[56] References Cited

U.S. PATENT DOCUMENTS

| | | | |
|---|---|---|---|
| 2,149,394 | 3/1939 | Gardner | 24/517 X |
| 2,577,064 | 12/1951 | Zenner | 24/517 X |
| 3,011,684 | 12/1961 | Corneil | 417/477 |
| 3,137,240 | 6/1964 | Hunt | 417/477 |
| 3,138,104 | 6/1964 | Cantor | 417/477 X |
| 3,523,000 | 8/1970 | Miller | 417/477 |
| 3,567,345 | 3/1971 | Ballentine | 417/477 |
| 4,231,725 | 11/1980 | Hogan | 417/477 |
| 4,412,793 | 11/1983 | Stenberg et al. | 417/477 |

*Primary Examiner*—Richard E. Gluck

*Attorney, Agent, or Firm*—Fitch, Even, Tabin & Flannery

[57] ABSTRACT

A peristaltic pump includes pivotal reaction members having reaction surfaces formed thereon for cooperation with a rotor in effecting peristaltic pumping action. The pump includes an improved adjustable tube-gripping assembly for securing a fluid flow tube of any size within a predetermined range in a predetermined position relative to the pump with only a minimal decrease of interior cross-sectional area. The preferred tube-gripping assembly includes a fixed gripping member and a movable yoke, each having notches formed therein for receiving the tube. A latch system for maintaining the pivotal reaction members in closed position applies relatively evenly distributed closing force along the joint between the reaction surfaces.

11 Claims, 10 Drawing Figures

FIG. 6
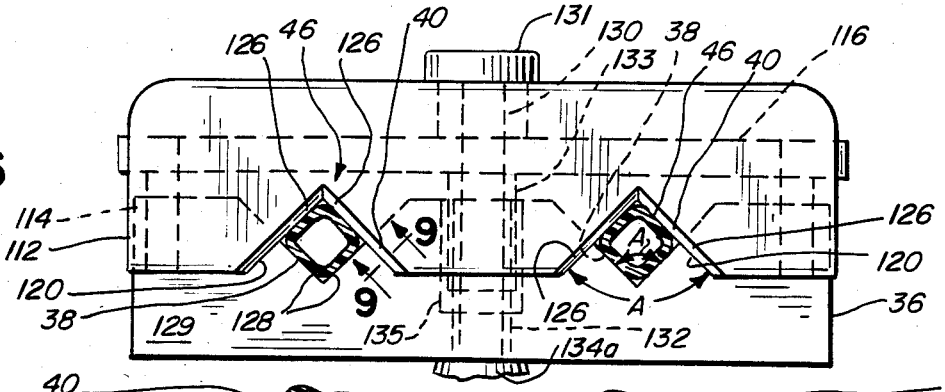
FIG. 7
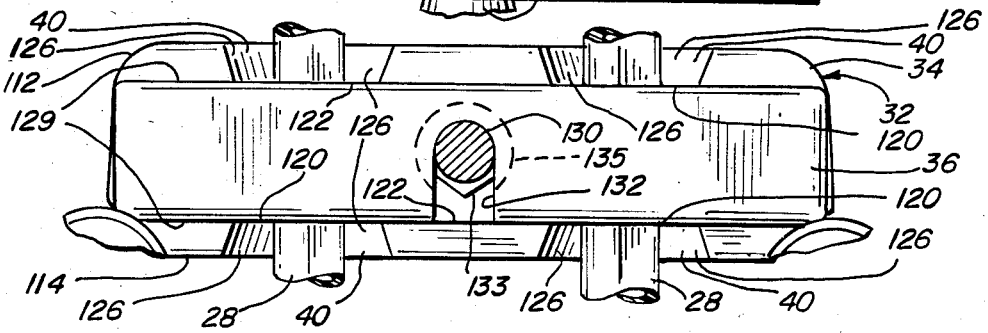
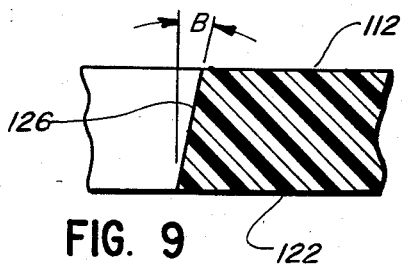
FIG. 9
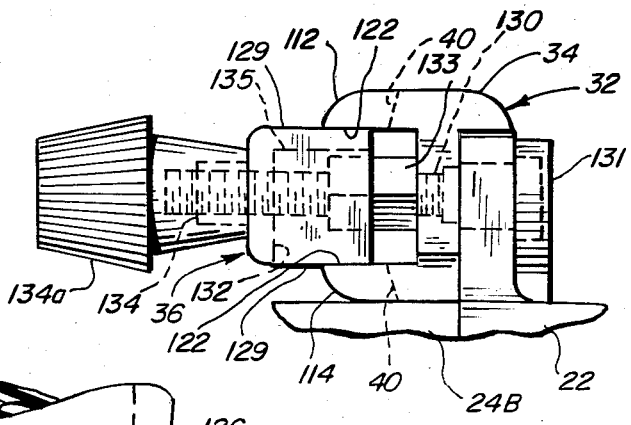
FIG. 8
FIG. 10
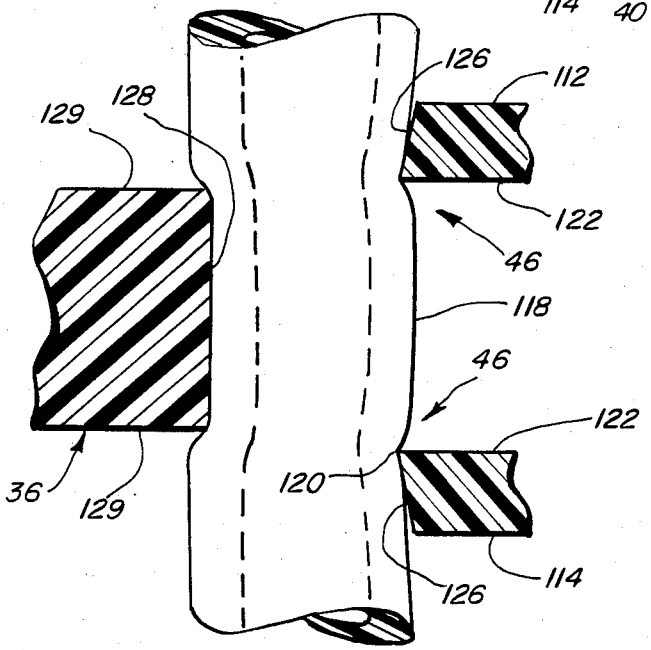

PERISTALTIC PUMP

BACKGROUND OF THE INVENTION

The present invention relates generally to peristaltic type pumps and more particularly to a peristaltic pump having movable reaction members.

Peristaltic pumps employing a rotor having one or more compression surfaces thereon operative to effective peristaltic action on a compressible flow tube maintained in predetermined relation to the rotor are generally known. Peristaltic pumps have been developed which permit quick loading or adjustment of a compressible flow tube relative to an associated pump rotor so that little down time is required when replacing or adjusting the flow tube in a pump. Examples of such pumps are disclosed in U.S. Pat. Nos. 4,179,249 and 4,231,725, both of which are assigned to the assignee of this application and which are incorporated herein by reference. In these pumps, reaction surfaces are provided on movable reaction members, often called clam shells, which are pivotal between an open position enabling loading and removal of a tube and a closed position wherein the tube is maintained in a predetermined position to enable peristaltic pumping action to take place.

To effect efficient pumping, it is desirable that relatively large compression forces be exerted on the tube by the compression surfaces on the rotor. In some known peristaltic pumps, pump efficiency has been decreased due to the force on the reaction members opening a small gap between the respective reaction surfaces.

The reaction members shown in U.S. Pat. No. 4,231,725 are held together in the closed pumping position by an outwardly facing lock nut which is threaded onto a stub shaft to bring a frustoconical cam surface thereon into camming engagement with cam surfaces on the reaction members. In order for the nut cam surfaces to properly engage the cam surfaces on the reaction members, the reaction members must be closely adjacent the closed position, e.g., within 0.010 inch of the closed position. However, some flow tubes are relatively hard and stiff as compared to other tubes and it is difficult to squeeze the harder and stiffer tubes, particularly the larger diameter sizes of these tubes, in order to get the cam surfaces engaged to allow turning of the nut. Also, for such tubes, it may be difficult for persons of limited strength to unscrew the nut after pump operation. Further, the cam nut is a relatively expensive item.

In this system, the nut and cam surfaces are located at the outer faces of the clam shells. Because the clam shells are made of plastic and the forces encountered during pump occlusion are high, a gap between the clam shells, increasing in width from front to rear, may occur in some instances. Another complicating factor is that the latch is located at the bottom ends of the clam shells, which are often located closely adjacent a horizontal support table or surface, allowing little room for swinging of a latching mechanism between its latching and unlatching positions. Thus, there is a need for improved means for maintaining the reaction members in closed position to avoid this problem.

There is also a need for improved means for maintaining the compressible flow tube in a predetermined position during a pumping operation. As the rotor rotates, it exerts longitudinal forces on the flow tube in addition to transverse compression forces. The longitudinal forces tend to pull the tube through the pump in the direction of rotation of the rotor. To counter this force, means are provided to grip the tube and prevent it from moving relative to the pump. However, because the tube is compressible, exertion of gripping force may reduce the cross sectional area for flow within the tube, thus increasing resistance to flow and decreasing pump efficiency.

The problem of restraining the tube against longitudinal movement is further complicated by the fact that tubes of various different sizes may be used in a particular pump and that lubricants or other materials may be on the tubes, making them slippery. There is a need for improved means to grip flow tubes of various different sizes without excessively restricting flow therethrough.

The range of tube outer diameters may range, for example, from 0.156 inch to 0.500 inch. Some tube retainers have two or three differently sized pairs of gripping notches for gripping tubes of different sizes, with the larger diameter tubes positioned outboard in outboard notches and the small diameter tubes positioned in inboard notches. In retainers of this type, relatively long portions of the tubes are unsupported between the reaction surfaces and the notches, particularly in the case of the smaller diameter tubes in the inboard notches. The unsupported tube lengths tend to vibrate and this has a deleterious effect on tube life and pump efficiency. Also, it would be preferred to increase the arcuate extent of the reaction surfaces so that a greater length of these tubes is engaged by reaction surfaces.

While it has heretofore been proposed to use a pair of opposed large V-shaped notches, each defining a 120° angle to grip up to five different sizes of tubes, this proposal has not overcome all of the aforementioned difficulties which may be overcome with the present invention.

SUMMARY OF THE INVENTION

In accordance with one aspect of the present invention, there is provided a peristaltic pump which includes an improved adjustable tube-gripping assembly for securing a fluid flow tube of any size within a predetermined range in a predetermined position relative to the pump with only minimal decrease of interior cross-sectional area. The preferred tube-gripping assembly includes a fixed gripping member and movable yoke, each having notches formed therein for receiving the tube. To enable the gripping assembly to grip the tube without excessively restricting flow therethrough, each of the notches preferably defines an included angle of about 90° and cooperates with an opposing notch to define a generally square aperture of variable size for receiving the tube.

Use of square apertures for gripping tubes of different sizes enables relatively high gripping forces to be achieved with relatively little decrease in cross-sectional area for tubes of all sizes within a particular range. To further improve gripping engagement of the tube, at least two of the notches herein have their edges beveled to an acute angle.

In accordance with another aspect of the present invention, the pump includes a clamp or latch assembly which applies relatively evenly distributed closing force along the joint between the reaction surfaces so as to maintain a substantially uninterrupted reaction surface by preventing any separation of the reaction surfaces along the joint. The latch assembly of the present invention is quick and simple to operate, economical to manufacture, and requires little clearance in use.

It is a general object of the present invention to provide an improved peristaltic pump.

It is another object of the present invention to provide a peristaltic pump which may accommodate tubes of various different sizes and which may be loaded and unloaded relatively quickly and simply.

Further objects and advantages of the present invention are set forth in the following description and illustrated in the accompanying drawings.

BRIEF DESCRIPTION OF THE DRAWINGS

FIG. 6 is a plan view of the tube-gripping assembly of the pump of FIG. 1 with portions of the tube being shown in section.

FIG. 7 is a front elevational view, partially in section, of the tube gripping assembly of FIG. 6.

FIG. 8 is a side elevational view of the tube gripping assembly of FIG. 6.

FIG. 9 is a sectional view taken substantially along line 9—9 of FIG. 6 and looking in the direction of the arrows.

FIG. 10 is a sectional view taken substantially along lines 10—10 in FIG. 2 and looking in the direction of the arrows.

DETAILED DESCRIPTION OF A PREFERRED EMBODIMENT

Figure 3:
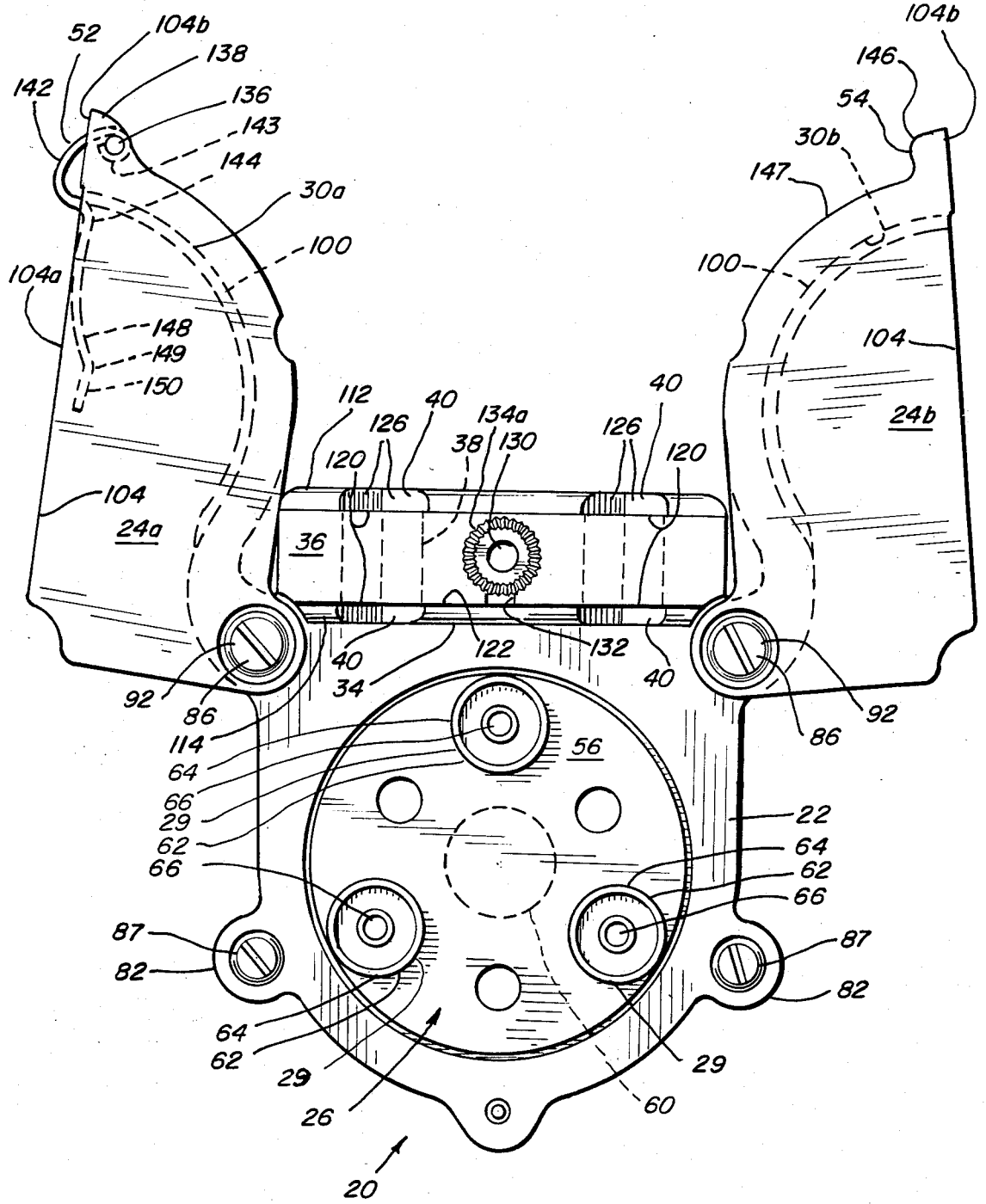
FIG. 3 is a front elevational view of the pump of FIG. 1 with the reaction members in open position.

The present invention is generally embodied in a peristaltic pump 20 which includes a housing or base plate 22 having reaction members 24*a* and 24*b* mounted thereon and a rotor 26 for effecting peristaltic pumping action by compressing portions of a flexible flow tube 28 which is looped about the rotor. The tube is compressed between compression surfaces 29 on the rotor 26 and reaction surfaces 30*a* and 30*b* on the reaction members 24*a* and 24*b* as the rotor 26 rotates. The reaction members 24*a* and 24*b* herein are pivotal as to be movable between an open position (FIG. 3) enabling loading and unloading of the flow tube 28, and a closed position for operation of the pump 20. When in closed position, the individual reaction surfaces 30*a* and 30*b* on the reaction members 24*a,b* cooperate to provide a substantially continuous reaction surface 30 at a predetermined radius from the axis of the rotor 26.

Herein, to provide for efficient displacement of fluid within the flow tube 28, over-occlusion of the tube is effected during pumping. Over-occlusion involves pressing the tube 28 flat and compressing the flattened tube so that the distance between the compression surfaces 29 and the reaction surfaces 30*a,b* is less than the undeformed thickness of the two layers of the tube wall therebetween. Over-occlusion exerts relatively high pressure on the reaction members 24*a* and 24*b* and requires that relatively high closing forces be applied to the reaction members 24*a,b* to maintain pump efficiency.

In various industrial and laboratory applications, it is desirable that a peristaltic pump of the type to which the present invention relates operate at high efficiency and be capable of accommodating several different sizes of tubing. It is further desirable that loading and unloading the flow tube be a relatively quick and simple task, and that the flow tube be held securely in place during operation of the pump.

In accordance with one aspect of the present invention, the pump 20 includes an improved adjustable tube-gripping assembly 32 for securing a fluid flow tube 28 of any size within a predetermined range in a predetermined position relative to the pump 20 with only a minimal decrease of interior cross-sectional area. The preferred tube-gripping assembly 32 includes a fixed gripping member 34 and a movable gripping member or yoke 36, each having notches 38, 40 formed therein for receiving the tube 28. To enable the gripping assembly 32 to grip the tube 28 without excessively restricting flow therethrough, each of the notches 38 preferably defines an included angle A (FIG. 6) of about 90° and cooperates with an opposing notch 40 also defining an included angle A of about 90° to define a generally square aperture 46 of variable size for receiving the tube. To improve gripping engagement of the tube 28, at least two of the notches 38, 40 herein have relatively sharp gripping edges 120 to effect acute localized deformation of the exterior of the tube.

In accordance with another aspect of the present invention, the pump includes a clamp or latch assembly 48 which applies relatively evenly distributed closing force along the joint 50 of the reaction surfaces 30*a* and 30*b* so as to maintain a continuous reaction surface 30 by preventing any separation of the reaction surfaces 30*a* and 30*b* along the joint 50. The preferred latch assembly 48 comprises a resilient latch member 52 pivotally mounted on one of the reaction members 24*a* for movement between a latched position wherein it exerts clamping force on a latch-engaging surface 54 on the other reaction member 24*b*, and an unlatched or open position (shown in phantom in FIG. 2). To Provide evenly distributed clamping pressure to the joint 50, the latch assembly is located generally centrally with respect to the width of the reaction surface 30. The latch-engaging surface 54 preferably extends generally parallel to the joint 50 and is generally longitudinally coextensive therewith. The latch member 52 is preferably made of spring steel or the like. The latch member 52 and latch-engaging surface 54 are preferably configured so that as the latch member 52 is pivoted into closed position, it cams the reaction members 24*a* and 24*b* together and snaps into a position of mechanical equilibrium.

Turning now to a more detailed description of the illustrated pump, the rotor 26 comprises a generally circular rotor plate 56 fixed to the inner end of a rotatable rotor shaft 60 and having three generally cylindrical compression members 62 extending therefrom generally parallel to the shaft. To enable the generally cylindrical compression surfaces 29 on the compression members 62 to engage in rolling contact with the tube 28 as they compress it, the compression members 62 are preferably mounted rotatably on the plate 56 so that as the rotor 26 rotates, the compression members 62 rotate about their axes. Herein, each of the compression members 62 comprises a roller 64 rotatably supported on a pin 66 through a suitable bearing (not shown). The pins 66 are suitably secured to the rotor plate 56 on a common radius in equidistantly circumferentially spaced relation.

Figure 4:
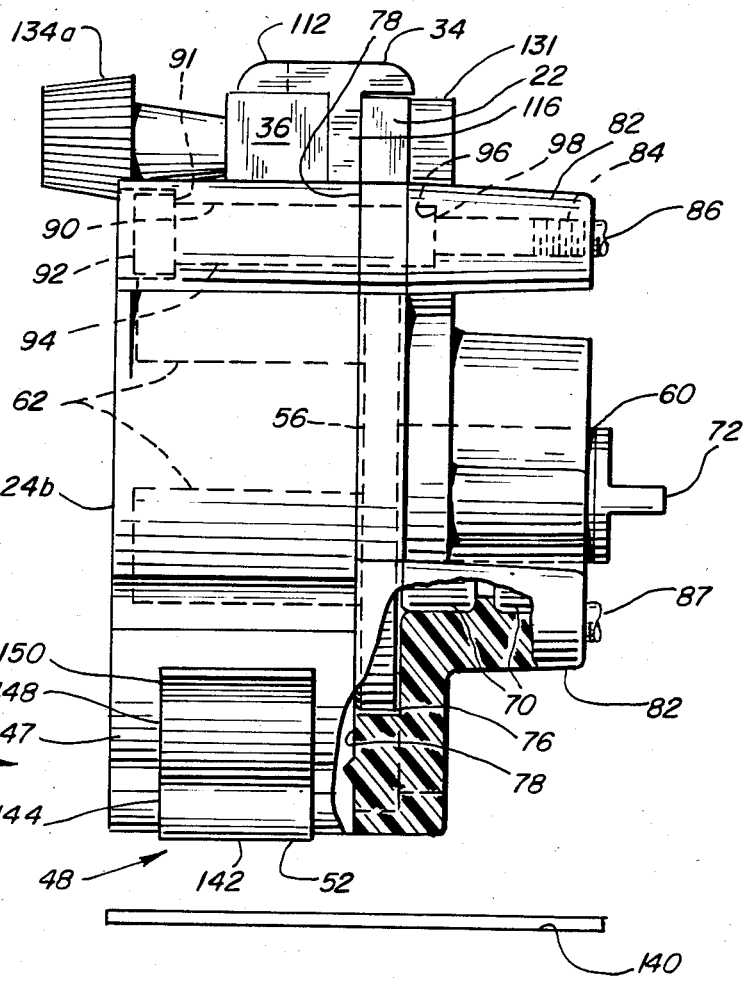
FIG. 4 is a side elevational view of the pump of FIG. 1 shown in mounted position on a support surface, with portions broken away and portions shown in section.
Figure 5:
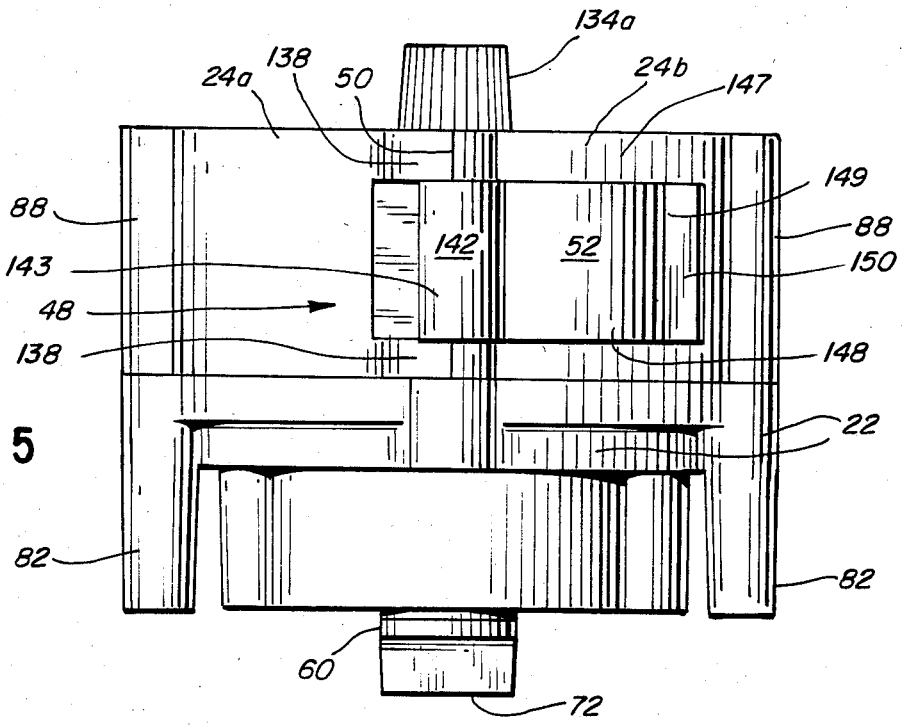
FIG. 5 is a bottom view of the pump of FIG. 1.

The base plate 22 is preferably made of a plastic material and has a bore 68 formed therethrough to receive suitable bearings 70 (FIG. 4). The shaft 60 is journaled through the bearings 70 and has its outer end 72 protruding therefrom for connection to drive means (not shown). A counterbore 76 is formed on the interior surface 78 of the base plate 22 to accommodate the rotor plate 56.

Referring particularly to FIG. 4, to enable mounting of the pump 20, a plurality of mounting bosses 82 are formed about the periphery of the base plate 22. Each of the mounting bosses 82 herein has an axial bore 84 therethrough for receiving a mounting screw 86 or 87. Herein, two of the mounting screws 86 also function as pivots for the movable reaction members 24*a,b*. To this end, each of the reaction members 24*a,b* includes an exterior pivot boss 88 having a bore 90 (FIG. 4) therethrough communicating with a bore 84 of one of the mounting bosses 82 on the base plate 22. Each of the bores 90 on the reaction members 24*a,b* has a counterbore 91 formed therein to accommodate the head 92 of its associated mounting screw 86. The mounting screw 86 has a generally cylindrical portion 94 thereon to provide a pivot for the associated reaction member 24*a,b*. Each of the two mounting screws 86 has an annular land 96 formed transversely thereof for engagement with a corresponding land 98 in its associated mounting boss 82 to maintain predetermined spacing between the head 92 of the screw 86 and the generally planar inner surface 78 of the base plate 22 so as to enable the mounting screws 86 to be tightened without restricting the pivoting of the reaction members 24*a,b*. The mounting screws 86 and 87 extend through the mounting bosses 82 and are fastened to a gear motor drive (not shown).

Figure 2:
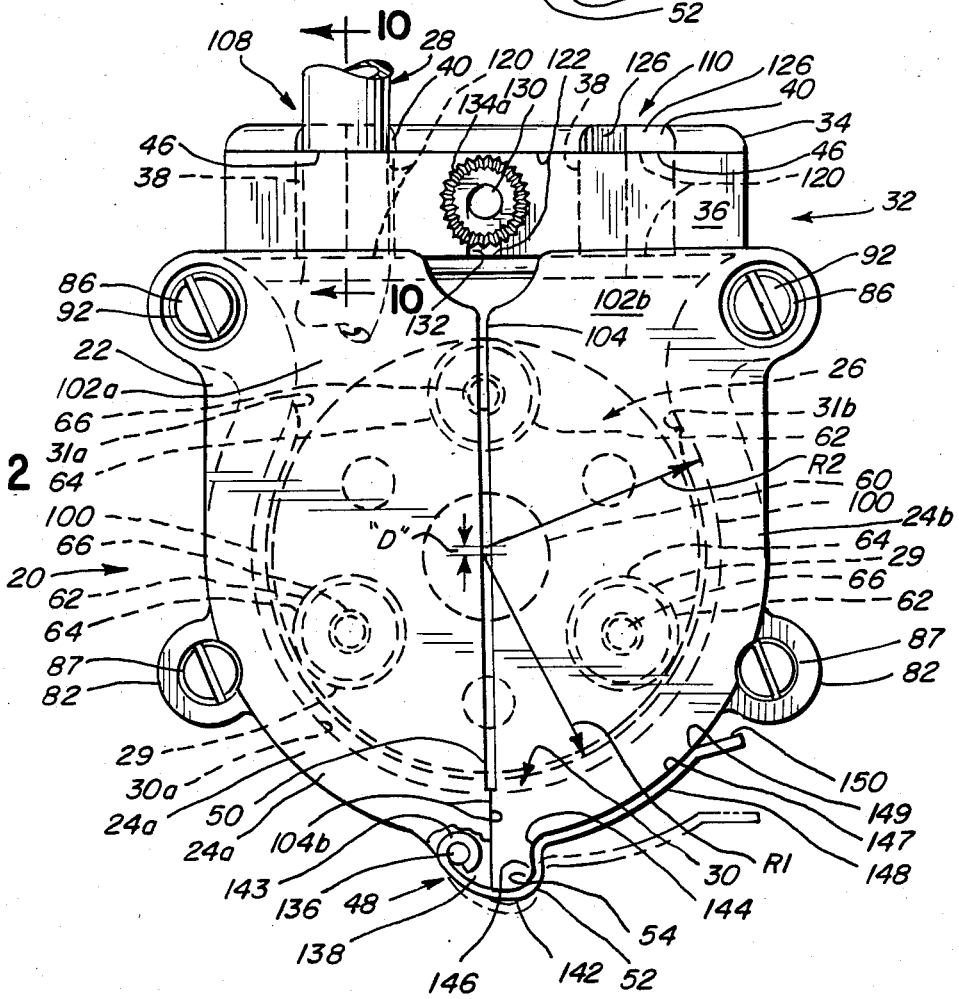
FIG. 2 is a front elevational view of the pump of FIG. 1

The reaction members 24*a,b* herein are generally symmetrical, each having an internal reaction surface 30*a,b* for cooperation with the compression surfaces 29 to effect peristaltic pumping action. In prior quick load pumps, the reaction surfaces above the centerline were substantially straight rather than being substantially arcuate as in this invention. Herein, the lower reaction surfaces are at a radius R1, as best seen in FIG. 2, from a horizontal line through the axis of the pump rotor. Spaced above this centerline by a distance "D", which herein is 0.080 inch, is the center of another radius R2 for the upper reaction surfaces. The upper reaction surfaces are joined at their lower ends by a straight section extending for 0.080 inch to the upper ends of the lower reaction surfaces. The radii R1 and R2 are equal in length and separated by 0.080 inch in the vertical direction. The total arcuate reaction surfaces are substantially greater than 180° and substantially greater than the prior quick load pump having straight upper sections with the result that the tube 28 is given a reverse bend at the upper reaction surfaces when extending to the retainer. This reverse bend is more effective than the straight line reaction surfaces of the prior art quick load pump in holding the tube against vibrating.

Figure 1:
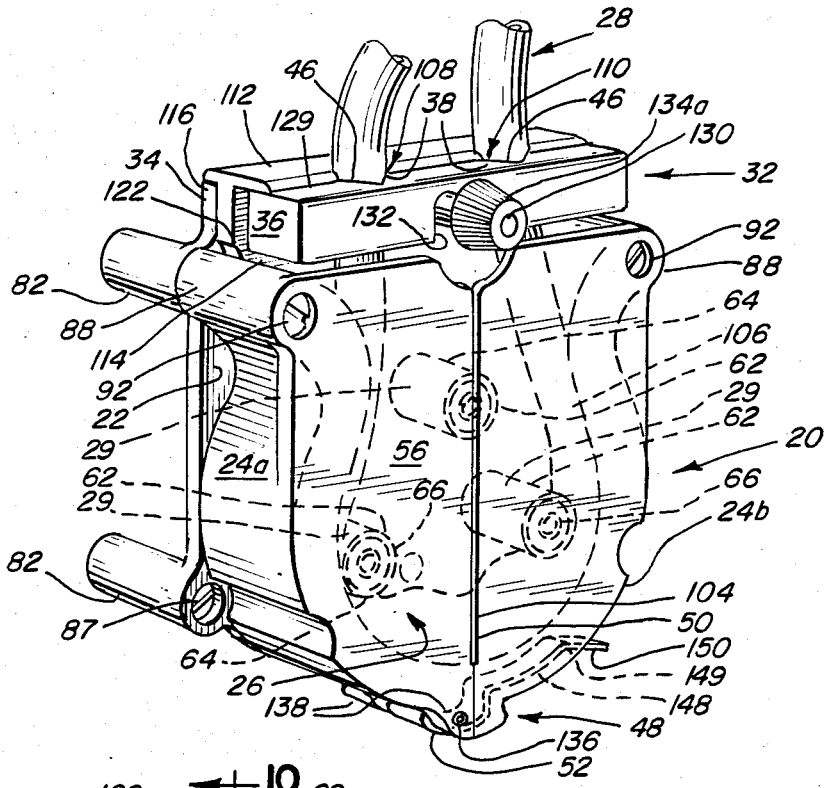
FIG. 1 is a perspective view of a pump in accordance with the present invention.

To prevent foreign objects from entering the pump interior during operation, the reaction members 24*a,b* include mutually cooperable outer flat cover plates or shield plates 102*a,b* which substantially cover the rotor 26 and looped portion 106 of the flow tube 28 when the reaction members 24*a,b* are in closed position. The shield plates 102*a,b* have mutually facing edge surfaces 104. As best seen in FIG. 2, the edges 10 of the shield plates are recessed at upper portions 104*a* and have lower portions abutted at 104*b* when the shield plates are closed. A gap about 0.020 inch is formed between the shield plates at the edges 104*a* at the center of the pump when the lower portions 104*b* are abutted and fastened together to hold the shield plates in the closed position. To permit visual observation of the rotor 26 and the looped portion 106 (FIG. 1) of the tube 28 during operation of the pump 20, the shield plates 102*a,b*, reaction members 24*a,b* and base plate 22 are preferably made of a clear plastic material, such as a polycarbonate. These materials are impact resistant, noncorrosive and suitable for use over a relatively wide range of temperature.

The flow tube 28 may be made of any of several suitable materials which are capable of enduring repeated flexure. The particular tube material selected may depend upon the temperature, viscosity, and chemical composition of the particular fluid being pumped.

As best seen in FIGS. 6–10, the preferred tube-gripping assembly comprises a fixed gripping member 34 and a movable yoke 36 for cooperation therewith. The flow tube 28 is looped around the interior of the pump 20 and is gripped at two locations 108 and 110 (FIG. 1), one on each side of the pump. For a given direction of pump rotation, one side of the loop 106 is the inlet side and the other is the outlet side. The inlet and outlet sides may be reversed by reversing the direction of rotation of the rotor 26.

The fixed gripping member 34 herein comprises a pair of generally parallel walls 112 and 114 spaced from one another by a distance slightly greater than the width of the yoke 36 and joined to one another by a web 116 (FIG. 6) which is fixed to the base plate 22. Each of the walls 112 and 114 has two notches 40 in it, one for each side of the loop 106 of tubing. The movable yoke 36 has corresponding notches 38 formed on it to engage the tube 28 between the walls 112 and 114 of the fixed gripping member 34 from the opposite direction. Adjustment means are provided to move the yoke 36 between an open position enabling loading and unloading of flow tubes 28 and a gripping position wherein the yoke 36 cooperates with the fixed gripping member 34 to grip the tube 28 between the corresponding notches 40 and 38 on the fixed member and yoke, respectively.

To grip the tube 28 securely without cutting into its exterior surface 118, the notches 38 and 40 on the fixed gripping member herein have relatively sharp gripping edges 120 (FIG. 10) on the inner surfaces of the respective walls to engage the tubing. The gripping edges 120 of each notch 40 are formed at the intersection of an inner wall surface 122 with two notch surfaces 126. The notch surfaces preferably intersect the inner wall surfaces 122 at an angle of about 80° and at a cross-sectional radius of curvature of about 0.01 in.

Each of the notches 40 in the yoke 36 is defined by a pair of generally planar surfaces 128 intersecting at approximately 90° to one another. Similarly, the gripping edges 120 of each of the notches 40 in the fixed gripping member intersect one another at 90°. Accordingly, when the yoke 36 is in gripping position, the tube 28 is compressed into a generally square-shaped cross-sectional configuration adjacent the inner wall surfaces 122, regardless of the size of the tube.

It is believed that compression of the tube 28 into a generally square-shaped cross-sectional configuration for gripping purposes is preferable to known alternatives because it minimizes increases in flow resistance while providing adequate gripping strength.

To enable the yoke to be guided by the inner wall surface 122 of the fixed gripping member 34 and to provide the desired cooperatiion between the notches 40 in the yoke and the gripping edges 120 on the fixed member 34, the width of the yoke 40 is slightly less than the distance between the inner wall surfaces 122, and the opposite facing side surfaces 129 of the yoke are generally parallel to one another and perpendicular to each of the yoke notch surfaces 128.

For the purpose of clamping the movable yoke 36 against the tubes with sufficient force, there is provided an adjustable means which comprises a stud 130 which is fixed to the base plate 22 and extends through the web 116 and through a slot 132 in the yoke 36. The head of the stud is mounted in a boss 131 on the base plate 22. Integral with the stud 130 is a hexagonal portion having a shoulder 133 which bears against the web 116 to secure the fixed gripping member 34 to the base plate 22. A nut 134 (FIG. 8) threadedly engages the stud 130 and bears against the yoke 36 so that rotation of the nut 134 in one direction displaces the yoke 36 toward the fixed member 34, increasing gripping force, while rotation in the opposite direction decreases gripping force and enables movement of the yoke 36 away from the fixed member. Rotation of the second nut 134 is facilitated by a ribbed knob 134*a* fixed thereto.

To facilitate loading and unloading of the hose 28, the slot 132 in the yoke 36 opens toward the pump interior so that the yoke may be removed from engagement with the stud 130 without removal of the nut 134 from the stud 130. A counterbore 135 is formed in the slot 132 to accommodate the hexagonal portion having shoulder 133.

In some peristaltic pumps, portions of the flow tube extending between the reaction surfaces and the means for gripping the tube may be subject to vibration. Such vibration is undesirable as it may be deleterious to pump performance and may decrease tube life. The tube 28 undergoes a reverse bend between the upper arcuate reaction surfaces and the retainer to assist in preventing such vibration.

In some known pumps, a row of different sized apertures is provided and the position of the tube is dependent upon its size. That is, a tube retainer has two or three pairs of retaining apertures with outboard pairs of apertures being located further outward than the notches 38 and 40 used herein, which are located generally inwardly of the upper terminal ends 31*a* and 31*b* (FIG. 2) of the respective reaction surfaces 30*a* and 30*b*. To accommodate the outboard pairs of apertures, the reaction surfaces end short of those shown herein in FIG. 2. As a result, the tube extends generally vertically when passing through the outboard apertures and extends a greater unsupported distance than do tubes held in the manner of the present invention; hence the tubes in the outboard apertures have a greater tendency to vibrate. The location of the inboard pairs of notches of these known tube retainers also results in greater lengths of tubing being unsupported than in the invention herein, and this also allows greater vibration which decreases the life and performance of the tubes. Thus, the configuration of the pump of the present invention provides improved efficiency and tube life.

Turning to a more detailed description of the latch assembly 48 of the present invention, the latch member 52 is preferably mounted on a pivot pin 136 which is supported by a pair of lugs 138 on one of the reaction members 24*a*. The latch member 52 herein latches against a latch-engaging surface 54 on the opposite reaction member 24*b*.

To keep the joint 50 closed tightly along the lower edge portions 104*b* which extend to the reaction surfaces, the latch assembly 48 is configured to provide closing force generally evenly along the length of the lower edge portions 104*b* of the joint. To this end, the latch-engaging surface 54, which transmits clamping force to the second reaction member 24*b*, is located generally centrally with respect to the width of the reaction surface 30. Also to this end, the lugs 138, which transmit clamping force to the first reaction member 24*a*, are located on opposite sides of the center of the reaction surface 30. The latch- engaging surface is generally parallel to the joint and is generally longitudinally coextensive therewith. The latch member 52 is configured to clamp against the latch-engaging surface 54 along a substantial portion thereof, which further aids in providing relatively evenly distributed closing force to the joint 50 along its entire length.

To provide a mechanical advantage for the latch assembly 48, the lugs 138, through which closing force is applied to the first reaction member 24*a*, and the latch-engaging surface 54, through which closing force is applied to the second reaction member 24*b*, are positioned at relatively large radii with respect to the pivots 86 for the reaction members. Accordingly, the clamping forces provided by the latch assembly 48 act along longer moment arms than do the forces generated by the compression of the tube 28 which tend to drive the reaction members 24*a* and 24*b* apart.

The pump 20 is often mounted at a location where relatively little clearance is provided between the latch 52 and a fixed table or horizontal surface 140 (FIG. 4). Thus, the latch 52 should be operable without having to swing through a large downward arc as would be precluded by the table surface 140. To prevent such interference, the latch assembly 48 of the present invention is configured so that movement between its latching position and its open position is effected by pivoting the latch member 52 through a relatively short arc, causing relatively little vertical displacement thereof.

The latch member 52 is integrally formed of spring steel or the like and includes a spring clamp portion 142 which is generally C-shaped in cross section and which has an end portion 143 wrapped around the pivot pin 136 for pivotal support thereon. To latch the reaction members 24 in closed position, manual closing force is initially applied thereto and the latch is moved into contact with the latch-engaging surface 54. As the latch 52 is moved further into closed position, a curved surface 144 on the C-shaped portion 142 slidingly engages a curved portion 146 of the latch-engaging surface 54 to cam the reaction members 24*a,b* together and elastically deform the C-shaped portion 142. As the reaction members 24*a,b* are moved into contact with one another by the camming action, the C-shaped portion 142 snaps into a position of mechanical equilibrium wherein its resiliency provides continuing closing force. To cause the snap action to occur during movement of the latch 52 into closed position, the curved surfaces 144 and 146 are curved outwardly toward each other at relatively small radii. The snap action makes the latch assembly 48 quick and simple to operate.

To further facilitate operation of the latch assembly 48, a lever portion 148 extends outwardly from the C-shaped portion 142. The lever portion 148 is curved so as to fit substantially against the exterior surface 147 of the second reaction member 24*b*. To facilitate manipulation of the lever portion 148 to move the latch 52 from latched position to unlatched position, a bend 149 is formed near the tip 150 of the lever portion 148 opposite the pivot pin 136 so that the tip extends outward from the surface 147. A fingertip can easily be inserted between the tip 150 of the lever portion 148 and the exterior surface 147 of the reaction member 24 to pry the lever portion away from the second reaction member, thus pivoting the latch member to open position. Once the latch member 52 is in open position, the reaction members 24*a,b* can be pivoted to their open positions.

To aid in the even distribution across the joint 50 of the closing force applied by the latch assembly 48, the width of the latch member 52 herein is approximately equal to or slightly less than the width of the reaction surface 30*a,b*, and the latch member 52 is approximately centered with respect to the width thereof. This helps to avoid the generation of excessive stress concentrations on the latch-engaging surface 54 and helps to provide balanced closing force so that the joint 50 is kept closed along its entire length during operation of the pump.

From the foregoing, it will be appreciated that the present invention provides a novel and improved peristaltic pump 20. The latch assembly 48 of the present invention is quick and simple to operate, requires little clearance, and improves pump efficiency by maintaining a tight joint 50 between the reaction surfaces 30*a,b* on the respective reaction members 24*a,b*. The tube gripping assembly 32 of the present invention enables tubes of any size within a predetermined range to be gripped securely without excessively restricting flow therethrough.

While a preferred embodiment of the invention has been described above and illustrated in the accompanyinq drawings, there is no intent to limit the scope of the invention to this or any particular embodiment.

What is claimed is:

1. A peristaltic pump comprising:

a base plate;

a rotor rotatably supported on the base plate and having at least two compression surfaces rotatable therewith through a predetermined path, the rotor having an axis extending through the base plate;

first and second reaction members having reaction surfaces thereon, the reaction members being mounted on the base plate for movement relative to the base plate between an open position spaced from the rotor to facilitate loading and removal of a compressible fluid flow tube relative to the rotor, and a closed position enabling peristaltic pumping action to be effected on the tube during rotation of the rotor;

means for selectively retaining the reaction members in the closed position, and gripping means for securing the compressible fluid flow tube in a predetermined position, the gripping means comprising first and second gripping members movable relative to one another, the first gripping member having a pair of generally V-shaped notches formed therein and the second gripping member having a pair of generally V-shaped notches formed therein opening toward the notches on the first gripping member for cooperation therewith in gripping the fluid flow tube;

each of the notches defining an included angle of about 90°.

2. A peristaltic pump in accordance with claim 1 wherein each of the reaction surfaces includes upper and lower arcuate portions joined by a short straight section therebetween.

3. A peristaltic pump in accordance with claim 1 wherein the first gripping member includes a wall surface and first and second notch surfaces, each of the notch surfaces intersecting the wall surface at an acute angle to define a relatively sharp gripping edge.

4. A peristaltic pump in accordance with claim 3 wherein each of the angles at the intersections of the notch surfaces with the wall surfaces has a value of about 80°.

5. A peristaltic pump in accordance with claim 4 wherein the gripping edge formed at the intersection of the notch surfaces with the wall surface has a cross-sectional radius of curvature of about 0.01 in.

6. A peristaltic pump comprising:

a base plate;

a rotor rotatably supported on the base plate and having at least two compression surfaces rotatably therewith through a predetermined path, the rotor having an axis extending through the base plate;

first and second reaction members having reaction surfaces thereon, the reaction members being mounted on the base plate for movement relative to the base plate beween an open position spaced from the rotor to facilitite loading and removal of a compressible fluid flow tube relative to the rotor, and a closed position wherein tne reaction surfaces meet to define a joint therebetween and wherein peristaltic pumping action may be effected on the tube during rotation of the rotor;

latch means for selectively retaining the reaction members in the closed position; and gripping means for securing the compressible fluid flow tube in a predetermined position, the gripping means comprising first and second gripping members movable relative to one another, the first gripping member being fixed to the base plate and including a pair of generally parallel notched walls extending transversely of the flow tube and connected by a web, the second gripping member having a pair of notches formed therein cooperable with the notches on the first gripping member to define substantially square apertures of variable size for gripping the flow tube; and means for moving and holding one of the gripping members at a clamping position to grip the tube tightly to prevent movement thereof during pumping.

7. A peristaltic pump in accordance with claim 6 wherein the means for moving and holding one of the gripping members comprises a stud extending through the web between the walls of the first gripping member and a nut threadedly engaging the stud and in abutting relation to a transverse surface of the second gripping member, and wherein the second gripping member has a slot formed therein to receive the stud so that the second gripping member is movable therealong, whereby gripping force may be adjusted by rotation of the nut.

8. A peristaltic pump in accordance with claim 7 wherein the slot on the second gripping member opens toward the pump to enable the second gripping member to be removed from engagement with the stud and nut without removing the nut from the stud.

9. A peristaltic pump in accordance with claim 6 wherein the latch means comprises a latch-engaging surface on the first reaction member extending generally parallel to the joint between the reaction surfaces and being generally longitudinally coextensive therewith and a movable latch member on the second reaction member for selective application of pressure to the latch engaging surface.

10. A peristaltic pump comprising:

a base plate;

a rotor rotatably supported on the base plate and having at least two compression surfaces rotatable therewith through a predetermined path;

first and second reaction members having reaction surfaces thereon, the reaction members being independently pivotally mounted on the base plate for movement relative to the base plate between an open position facilitating loading and removal of a compressible fluid flow tube relative to the rotor, and a closed position wherein the reaction surfaces meet to define a joint therebetween and wherein peristaltic pumping action may be effected on the tube during rotation of the rotor; and latch means for selectively applying clamping force along the joint between the reaction surfaces, the latch means comprising a one-piece latch member of spring metal pivotally mounted to the first reaction member adjacent said joint, a projection means on the second reaction member adjacent the joint and extending substantially across the joint and having a camming surface thereon, a curved clamp portion integrally formed on the latch member for camming engagement with said camming surface and to cam thereacross and to elastically deform the one-piece latch member as the clamp portion snaps behind the projection means, said elastically deformed latch member exerting a biasing force across the length of the joint to abut said first and second reaction members at the joint, and an integral release portion on the latch member projecting outwardly from the second reaction member to be grasped and to be pulled outwardly from the said second reaction member to deflect the latch member and to slide the curved clamp portion back across the camming surface to release the biasing force abutting the reaction members together at the joint.

11. A peristaltic pump in accordance with claim 10 wherein the latch-engaging surface is generally parallel to the joint between the reaction surfaces and is generally longitudinally coextensive with said joint.

* * * * *